United States Patent [19]

Hashimoto et al.

[11] Patent Number: 4,661,316

[45] Date of Patent: Apr. 28, 1987

[54] HEAT-RESISTANT ALLOY BASED ON INTERMETALLIC COMPOUND TIAL

[75] Inventors: Kenki Hashimoto, Chiba; Haruo Doi, Fijimi; Tsujimoto Tokuzou, Yokohama; Nakano Osamu, Kokubunji; Nobuki Minoru, Urayasu, all of Japan

[73] Assignee: National Research Institute for Metals, Tokyo, Japan

[21] Appl. No.: 760,502

[22] Filed: Jul. 30, 1985

[30] Foreign Application Priority Data

Aug. 2, 1984 [JP] Japan ..... 59-161601

[51] Int. Cl.[4] ..... C22C 14/00

[52] U.S. Cl. ..... 420/418; 420/420

[58] Field of Search ..... 420/420, 418

[56] References Cited

U.S. PATENT DOCUMENTS 3,203,794 8/1965 Jaffee et al. ..... 420/418

4,294,615 10/1981 Blackburn et al. ..... 148/133

FOREIGN PATENT DOCUMENTS 219731 7/1957 Australia ..... 420/418

*Primary Examiner*—Veronica A. O'Keefe

*Attorney, Agent, or Firm*—Wenderoth, Lind & Ponack

[57] ABSTRACT

A heat-resistant alloy comprising an alloy based on an intermetallic compound TiAl composed of 60 to 70% by weight of titanium and 30 to 36% by weight of aluminum, and 0.1 to 5.0% by weight of manganese.

4 Claims, 1 Drawing Figure

HEAT-RESISTANT ALLOY BASED ON INTERMETALLIC COMPOUND TIAL

BACKGROUND OF THE INVENTION

1. Field of the Invention

This invention relates to a heat-resistant alloy based on an intermetallic compound TiAl, which is suitable for use as a light-weight heat-resistant material. More specifically, it relates to a heat-resistant alloy based on an intermetallic compound TiAl, which has improved mechanical strength, ductility at room temperature and strength at high temperatures.

2. Description of the Prior Art

It is known that an intermetallic compound TiAl (to be referred to as a TiAl phase) in which about 35 to 60% by weight of aluminum has a crystal structure $Ll_0$ exists in a titanium-aluminum binary system. The TiAl phase has excellent properties among which are:

(1) it is light in weight;

(2) it has good oxidation resistance at high temperatures;

(3) its strength increases with increasing temperature, and becomes maximum at about 700° C.; and (4) it has good creep strength at high temperatures.

However, it has poor ductility at room temperature and is difficult to deform plastically by conventional fabricating machines because of the strong dependence of plasticity on the strain rate at high temperatures. For this reason, the TiAl phase has not gained practical acceptance. Attempts have been made to solve these problems and to have the TiAl phase exhibit its excellent properties by adding various third and fourth elements which can dissolve in the TiAl phase, or by dispersing a second phase in addition to the TiAl phase. Known intermetallic compound TiAl-base alloys successfully having improved ductility at room temperature are a Ti-34.1% by weight Al-3.4% by weight V alloy (U.S. Pat. No. 4,294,615) and a Ti-41.7% by weight Al-10% by weight Ag alloy (Japanese Laid-Open Patent Publication No. 123847/1983). The alloy of the U.S. Patent having improved ductility has an elongation of only about 2% at room temperature, and it is desired to improve its ductility further. Furthermore, its strength at high temperature is not entirely satisfactory. The Ag alloy, on the other hand, has greatly improved ductility at room temperature, but has markedly reduced strength at temperatures exceeding 600° C. Such an alloy is unsuitable as a high-temperature heat-resistant material.

SUMMARY OF THE INVENTION

It is an object of this invention to provide a TiAl-base heat-resistant alloy having further improved strength and room temperature ductility without impairing the excellent physical properties of the intermetallic compound TiAl.

According to this invention, there is provided a heat-resistant alloy comprising (i) an alloy based on an intermetallic compound TiAl composed of 60 to 70% by weight of titanium and 30 to 36% by weight of aluminum and (ii) 0.1 to 5.0% by weight of manganese.

DETAILED DESCRIPTION OF THE INVENTION

Figure 1:
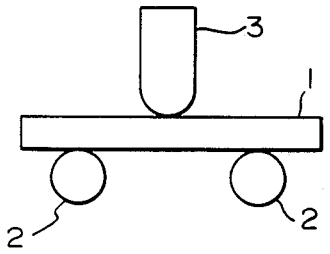
FIG. 1 shows a jig and a test specimen used in a three-point bending test described hereinafter. The test specimen is indicated at 1 and has a thickness of 2.5 mm, a width of 5.0 mm and a length of 25.0 mm. The reference numerals 2 represent supporting rods (with a radius of 2.5 mm) for supporting the test specimen. The distance between the supporting rods is 16.0 mm. The reference numeral 3 represents a pressing member having a radius of 2.5 mm at its tip.

It has been known that in a titanium-aluminum binary system, a two-phase alloy consisting of a TiAl phase and an intermetallic compound $Ti_3Al$ (to be simply referred to as a $Ti_3Al$ phase) having a crystal structure $DO_{19}$ forms when its aluminum content is in the range of 26 to 35% by weight.

The present inventors examined relations between the microstructure and mechanical properties of this two-phase alloy at varying Al contents. It was consequently found that in a binary alloy of titanium and aluminum, the proportion of the $Ti_3Al$ phase increases and the alloy becomes brittle when the aluminum content is less than 30% by weight, and that the $Ti_3Al$ phase vanishes and the alloy has a coarse texture and reduced ductility when the aluminum content exceeds 36% by weight. When the aluminum content is 30 to 36% by weight, preferably 31 to 35% by weight, the proportion of the TiAl phase becomes larger than that of the $Ti_3Al$ phase, and the alloy has a finer texture and increased ductility. However, the bonding force between the TiAl phase and the $Ti_3Al$ phase was not sufficient, and the present inventors thought that if this bonding force is increased, ductility would further increase. Attempts were made therefore to improve the bonding force by adding third elements. Specifically, manganese, niobium, zirconium and vanadium were selected as the third elements, and by adding these elements, the textures and mechanical properties of the resulting alloys were examined. It was consequently found that the addition of these third elements increases the amount of annealed twins and makes the texture of the alloy finer. In particular, it was found that the addition of at least 0.1% by weight of manganese improves the bonding force between the TiAl phase and the $Ti_3Al$ phase and further increases the ductility of the alloy, and that if the amount of manganese exceeds 5% by weight, a compound having the composition $Ti_3Al_3Mn_2$ forms to reduce the ductility. It has been found specifically that the addition of 0.1 to 5.0% by weight of manganese can improve not only the mechanical strength but also the ductility of the alloy. The preferred amount of manganese is 0.5 to 3.0% by weight.

The TiAl-base heat-resistant alloy of this invention thus contains 0.1 to 5.0% by weight of manganese. Depending upon the end usage of the alloy, it may further contain zirconium (0.6 to 2.8% by weight), vanadium (0.6 to 1.9% by weight), niobium (1.6 to 4.0% by weight), tungsten (0.5 to 1.2% by weight), molybdenum (0.5 to 1.2% by weight), and carbon (0.02 to 0.12% by weight). For example, the addition of zirconium, niobium or tungsten as a fourth element improves grain boundary embrittlement and increases strength. The addition of vanadium increases ductility although slightly decreasing strength. The addition of carbon increases high-temperature strength although decreasing ductility.

Manganese may be added as a manganese alloy.

By the addition of a specified amount of manganese, the intermetallic compound TiAl-based heat-resistant alloy of this invention improves mechanical strength and ductility, and the inherent properties of the TiAl phase can be exhibited. It also has excellent high temperature strength. The alloys shown in the Example have a specific strength at 500° C. or higher exceeding that of INCO713C which is a typical nickel-base heat-resistant alloy.

While in the past, nickel-base heat-resistant alloys have been used at temperatures higher than 600° C. in aircraft engines, etc. If the alloy of this invention is used instead of these alloys, the aircraft engine can be made lighter in weight and higher in performance.

EXAMPLE

A Ti-33.3% by weight Al-2.1% by weight Mn alloy (to be referred to as the Mn-added alloy) was prepared from sponge titanium having a purity of 99.7%, aluminum having a purity of 99.99%, and manganese having a purity of 99.9%. Specifically, predetermined amounts of the above materials were weighed, and formed by a press into a briquette having a diameter of 40 mm and a height of about 50 mm. The briquette was arc-melted in a water-cooled copper crucible in an argon atmosphere using a tungsten electrode and the ingot was heat-treated for 7 days at 1000° C. under an evacuated atmosphere of $10^{-3}$ Pa. pressure.

A test specimen having a square cross section with each side measuring 3 mm and a height of 6.8 mm, and a rectangular test specimen having a length of 24 mm, a thickness of 2.5 mm and a width of 5 mm were cut out from the alloy. The former specimen was subjected to a compression test, and the latter, to a 3-point bending test.

The results of these tests are shown in Tables 1, 2 and 3.

In the compression test, the fracture strength is a value obtained by dividing the load at the time of crack formation by the cross sectional area of the specimen. The compression rate is a value calculated by the following formula.

[(the initial height of the test specimen)—(the height of the test specimen upon cracking)] ÷ (the initial height of the test specimen) × 100

Proof stress is a value obtained by dividing the load at 0.2% compressive deformation by the initial cross-sectional area of the test specimen.

In the bending test, the fracture strength is defined by the following equation.

$$[1.5F \times l \div (W \times t^2)]$$

F: the load upon cracking of the test specimen,
W: the width of the test specimen,
t: the thickness of the test specimen,
l: the distance between the supporting points of the 3-point testing jig (shown in FIG. 1).

The proof stress is a value obtained by substituting the load $F_s$ at the start of plastic deformation for the equation used in obtaining the fracture strength.

The amount of deflection is the distance over which the pressing rods (shown in FIG. 1) moved from immediately before the application of the load until the load caused breakage of the specimen.

These properties have the following significances.

Proof stress

Generally, application of a small force to a material deforms it, and upon removal of the force, the material regains the original state. If, however, the applied force exceeds a certain limit, the deformation remains even upon removal of the force. The stress corresponding to this limit is the proof stress. Hence, a heat-resistant material having a higher proof stress is better.

Fracture strength

When a force to be applied to the material is increased, cracks will form and finally the material will break. The stress upon the generation of these cracks is defined as the fracture strength. Hence, a heat-resistant material having higher fracture strength is better.

Compression rate

This is a limit below which a material can be deformed by compression without the formation of cracks, and is one measure of its ductility. The larger the compression rate, the higher is the ductility of the material.

Amount of deflection

This is a limit below which a material can be deformed by bending without the formation of cracks, and is one measure of the tensile ductility of the material. The larger this value, the higher is the ductility of the material.

For comparison, a Ti-34.8% by weight Al-3.4% by weight V alloy (see U.S. Pat. No. 4,294,615; to be referred to as the Ti-Al-V alloy), a Ti-34.0% by weight Al alloy (a TiAl-base two-phase alloy containing $Ti_3Al$) and a Ti-37% by weight Al (a TiAl single-phase alloy) prepared under the same conditions as in the preparation of Mn-added alloy were subjected to the compression test. The results are shown in Table 2.

TABLE 1

Compression characteristics of the Mn—alloy

| Testing temperature | Proof stress ($Kgf/mm^2$) | Fracture strength ($Kgf/mm^2$) | Compression rate (%) |
|---|---|---|---|
| Room temperature | 54.1 | 152.1 | 48.5 |
| 500° C. | 53.8 | 146.7 | 50.2 |
| 600° C. | 83.4 | 168.2 | 47.5 |
| 700° C. | 58.4 | 103.2 | 70.6 |

TABLE 2

Compression characteristics of the comparative alloys

| Alloy | Temperature (°C.) | Proof stress ($Kgf/mm^2$) | Fracture strength ($Kgf/mm^2$) | Compression rate (%) |
|---|---|---|---|---|
| TiAl single phase alloy | 23 | 32.6 | 38.9 | 6.4 |
| | 700 | 34.1 | 102.4 | 41.7 |
| Two phase alloy $Ti_3Al$ | 23 | 43.2 | 131.3 | 32.6 |
| | 700 | 36.2 | 102.6 | 52.4 |
| Ti—Al—V alloy | 23 | 40.5 | 112.3 | 42.7 |
| | 700 | 38.5 | 98.7 | 64.4 |

For comparison, Table 3 also shows the room-temperature bending properties of the TiAl single phase alloy, the TiAl-base alloy containing $Ti_3Al$, and the Ti-Al-V alloy prepared above.

TABLE 3

3-Point bending properties of the Mn-added added alloy and comparative alloys

| Alloy | Proof stress ($Kgf/mm^2$) | Fracture strength ($Kgf/mm^2$) | Amount of deflection (mm) |
|---|---|---|---|
| Mn-added alloy | 53.7 | 81.7 | 0.52 |
| TiAl single phase alloy | 45.1 | 50.3 | 0.28 |
| TiAl-base 2-phase alloy | 47.2 | 53.7 | 0.36 |
| Ti—Al—V alloy | 39.7 | 48.4 | 0.48 |

The results given in Tables 1, 2 and 3 clearly demonstrate that the improvement of ductility and strength by the addition of manganese in accordance with this invention is remarkable. Furthermore, it is seen that the alloy of this invention has much higher fracture strength than the Ti-Al-V alloy although it shows only a slight increase in ductility as compared with the latter.

What is claimed is:

1. A heat-resistant alloy consisting essentially of (1) an alloy based on an intermetallic compound TiAl composed of 60 to 70% by weight of titanium and 30 to 36% by weight of aluminum and (2) 0.1 to 5.0% by weight of manganese.

2. The alloy of claim 1 wherein the content of aluminum is 31 to 35% by weight.

3. The alloy of claim 1 wherein the amount of manganese is 0.5 to 3.0% by weight.

4. The alloy of claim 1 which further contains at least one element selected from the group consisting of (a) zirconium in an amount of 0.6 to 2.8% by weight;
(b) niobium in an amount of 10.6 to 4.0% by weight;
(c) vanadium in an amount of 01.6 to 1.9% by weight;
(d) tungsten in an amount of 0.5 to 1.2% by weight;
(e) molybdenum in an amount of 0.5 to 1.2% by weight; and
(f) carbon in an amount of 0.02 to 0.12% by weight.

* * * * *